United States Patent [19]

McLennan et al.

[11] 3,978,793

[45] Sept. 7, 1976

[54] MUZZLE-EXPELLABLE CARTRIDGE

[75] Inventors: William S. McLennan, Wharton, N.J.; George C. Potts, deceased, late of Philadelphia, Pa., by Mary P. Potts, executrix

[73] Assignee: The United States of America as represented by the Secretary of the Army, Washington, D.C.

[22] Filed: June 30, 1975

[21] Appl. No.: 591,802

[52] U.S. Cl. ..... 102/38; 89/14 R; 89/17; 89/26; 102/40; 102/43 R

[51] Int. Cl.[2] ..... F42B 5/02

[58] Field of Search ..... 42/76 R; 89/14, 1.706; 102/38, 39, 40, 43 R, 43 C, 43 P, 44, 49.1, 49.2

[56] References Cited

UNITED STATES PATENTS

| | | | |
|---|---|---|---|
| 430,229 | 6/1890 | Garland | 102/40 |
| 1,940,657 | 12/1933 | Woodford | 102/43 |
| 3,485,170 | 12/1969 | Scanlon | 102/38 |
| 3,696,749 | 10/1972 | Scanlon | 102/38 X |
| 3,712,225 | 1/1973 | Nimylowycz | 102/40 X |

FOREIGN PATENTS OR APPLICATIONS

| | | | |
|---|---|---|---|
| 80,541 | 6/1951 | Czechoslovakia | 102/38 |
| 605,136 | 7/1948 | United Kingdom | 42/76 R |

*Primary Examiner*—Harold Tudor
*Attorney, Agent, or Firm*—Nathan Edelberg; A. Victor Erkkila; Thomas R. Webb

[57] ABSTRACT

A muzzle-expellable gun cartridge comprises a case including a side wall adapted to fit the gun chamber and having an open front end and a transverse rear base, a projectile releasably mounted in the front end, a main propellant charge within the case in the front of the base, an auxiliary propellant charge located behind the base for propelling the case through the barrel after propulsion of the projectile therefrom, a primary charge for initiating the two propellant charges, and means for providing spaces between the case and the chamber and for venting part of the propellant gases to these spaces between the case and the chamber to collapse the case side wall and facilitate expulsion of the case, comprising an annular series of external longitudinal flutes and intermediate ribs formed in the side wall with aperture flaps in the flutes for venting the gases through the side wall into the flutes.

7 Claims, 4 Drawing Figures

MUZZLE-EXPELLABLE CARTRIDGE

GOVERNMENTAL INTEREST

The invention described herein may be manufactured, used, and licensed by or for the Government for governmental purposes without the payment to us.

BACKGROUND AND SUMMARY OF THE INVENTION

The present invention relates to a new and improved muzzle-expellable gun cartridge.

Garland patent No. 430,229, for example, discloses a muzzle-expellable cartridge having a main charge for propelling the projectile from the cartridge case and barrel, and an auxiliary charge for expelling the case through the gun barrel after the projectile has been expelled therefrom.

An object of the invention is to provide the cartridge case with means for facilitating the forward expulsion of the case from the chamber.

In accordance with the invention, the cartridge case side wall is formed with longitudinal flutes and intermediate ribs which extend almost the full length of the side wall, and apertures in the flutes to permit propellant gases to pass through the side wall to the longitudinal spaces provided by the flutes, to collapse the side wall inwardly and thereby release it from the barrel chamber.

Czechoslovakian patent 80,541 (in 102-38) discloses a rearwardly-extracted cartridge case having openings in an annular external groove, for a similar purpose, without longitudinal flutes.

BRIEF DESCRIPTION OF THE PREFERRED EMBODIMENTS

Figure 1:
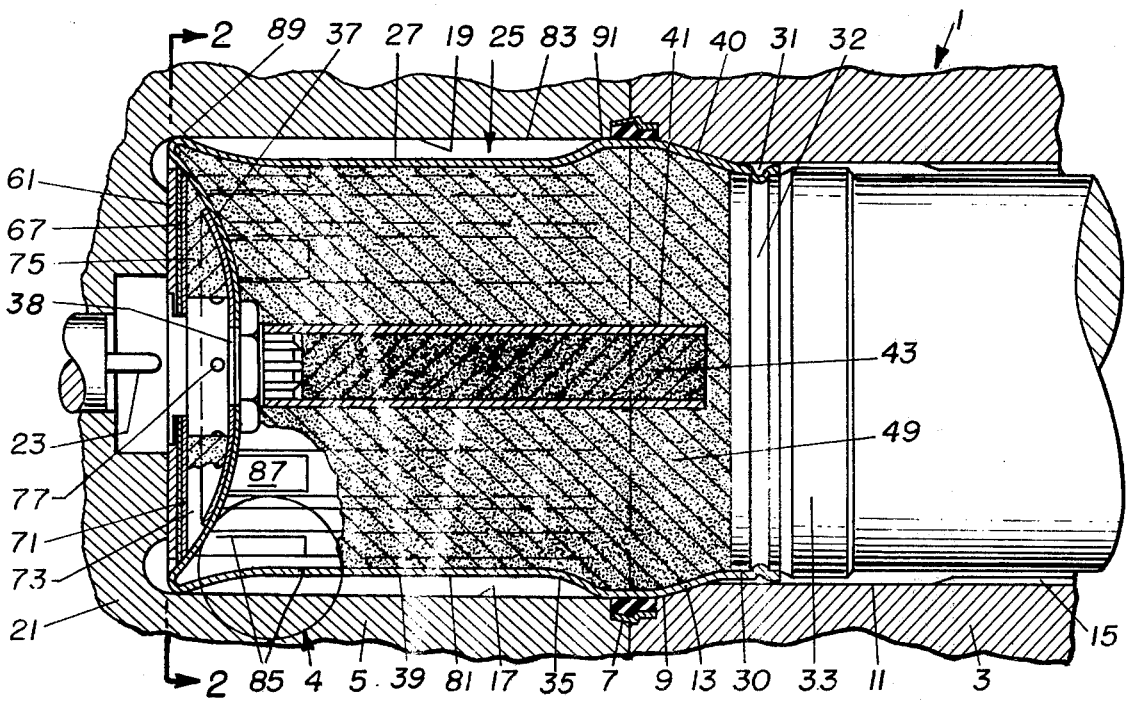
FIG. 1 is a longitudinal section view of a muzzle-expellable cartridge embodying the invention, positioned within the barrel chamber of a gun for firing the cartridge.
Figure 2:
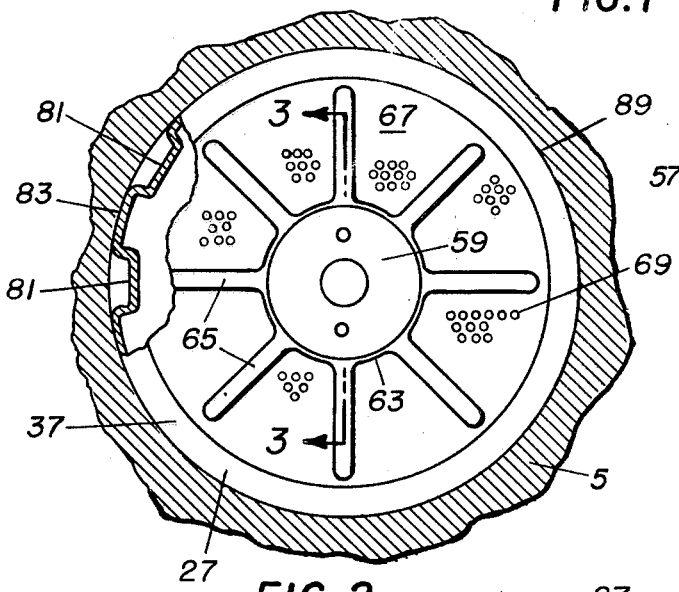
FIG. 2 is a transverse section view taken on line 2—2 of FIG. 1.

FIGS. 1–4 illustrate the invention as embodied, for example, in a 152 mm. high explosive artillery cartridge to be fired in a two-part gun barrel. The numeral 1 indicates a gun barrel made up of a front barrel part 3 and a rear chamber part 5, with a gas seal 7 sealing the joint between the two parts. The front part 3 includes a short chamber portion 9 and a smaller-diameter bore 11 connected by a tapered portion 13. The bore 11 is formed with the usual rifling lands 15 for rotating the projectile as it passes therethrough. The rear part 5 includes a cylindrical main chamber portion 17, having the same diameter as the portion 9, which cooperates with the portion 9 to form a cartridge chamber 19. Rear part 5 also includes a breech portion 21 having a firing pin 23.

A cartridge 25, positioned within the chamber 19 and bore 11, comprises a case 27 and a projectile 29 releasably mounted in a short reduced-diameter the forward end portion 30 of the case by crimping a portion 31 of the case into a crimping groove 32 on the projectile. The projectile has a rotating band 33 for cooperation with the rifling lands 15.

Figure 3:
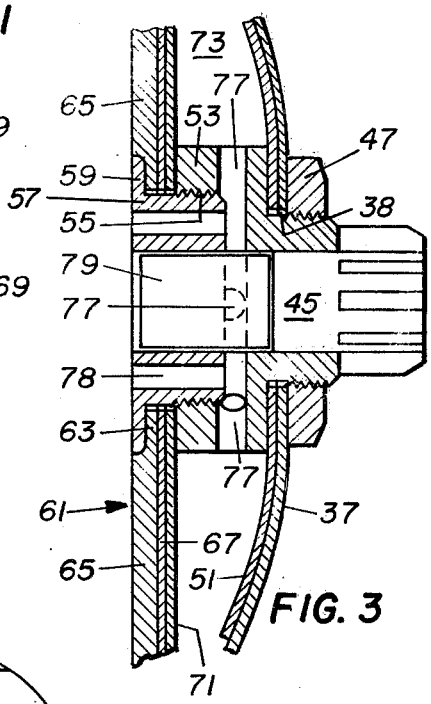
FIG. 3 is an enlarged section view taken on line 3—3 of FIG. 2.

The cartridge case 27 comprises a side wall 35 integral with an inwardly-dished transverse rear wall 37 having a central opening 38. The side wall 35 comprises a generally-cylindrical long rear portion 39 connected to the short forward end portion 30 by an integral tapered portion 40. An elongated tubular igniter element 41, filled with an igniting material 43, is axially mounted within the case 27 by means of a hollow hub 45 which extends through the opening 38 and is held by a threaded nut 47 (FIG. 3). The space within the case 27 surrounding the igniter element 41 is filled with low explosive material 49 for propelling the projectile 29 through the barrel 1. A thin spring reinforcing washer 51 is clamped against the rear face of rear wall 37 by a flange 53 on the hub 45. A rear portion of hub 45 is formed with a threaded recess 55 to receive a threaded annular member 57 having a flange 59. Sandwiched between the flange 59 and flange 53 are, in order, a spider element 61 comprising a central ring 63 and eight radial legs 65, a perforated disc 67 having a multiplicity of close-spaced small apertures 69, and a thin rupturable solid metal disc 71. The outer edges of the two discs 67 and 71 engage the outer edge of the rear wall 37 to form an auxiliary charge cavity 73 surrounding hub 45, which is filled with case propellant material 75. Four radial openings 77 in hub 45 provide flash passages between the interior of the hub and the cavity 73. Two axial openings 78 are formed in the annular member 57 to cooperate with a spanner wrench during assembly of the parts and to provide further venting of the auxiliary propellant gases through the rear end of the case. An initiator 79 is mounted in the rear end of hub 45, for initiation by the gun firing pin 23 to initiate the igniter material 43 and thereby ignite the propellant materials 49 and 75, to expel the projectile 29 and ignite the propellant materials 49 and 75, to expel the projectile 29 and case 27. When the material 75 is ignited, the generated gases rupture the disc 71 at the perforations 69 in disc 67 and contact the front face of the breech member 21 through the spider 61.

Figure 4:
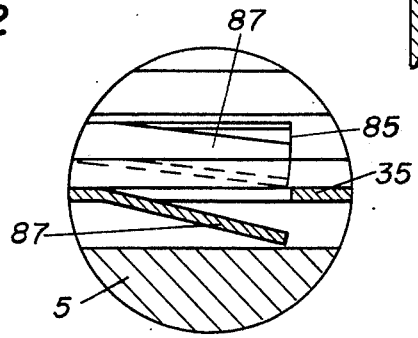
FIG. 4 is an enlarged section view of the circular area 4 in FIG. 1 after expulsion of the projectile from the case.

In firing tests of cartridges as described above, but having imperforate cylindrical side walls snugly fitting the wall of chamber 19, it was found that the case 27 could not be satisfactorily expelled from the chamber by the auxiliary charge 75 because of the friction between the case 27 and the wall of chamber 19 exaggerated by the outward pressure due to the burning gases. In accordance with the present invention, longitudinal flutes or grooves 81 and intermediate ribs 83 are formed in the side wall 35 of the case 27, extending substantially the entire length of the side wall 35; and apertures 85 are formed in the flutes 81, to permit part of the burning propellant gases to pass through the spaces provided by the flutes 81 between the exterior of the case and the chamber wall. As the gas pressure drops within the case 27, these external gases collapse the side wall 35 to smaller diameter, permitting the case 27 to be expelled by the gases generated by the auxiliary propellant material 75. The apertures 85 are preferably provided by partially-severed flaps 87, forming integral parts of the side wall 35, adapted to be opened outwardly by the internal gas pressure, as shown in FIG. 4. Preferably, the apertures 85 are located near the rear ends of the flutes 81, and the flaps 87 extend forwardly, as shown. The flutes 81 extend along the major portion of the length of the case 27. Preferably, the flutes run out short of the ends of the case to form annular lands 89 and 91 on the rear portion 39 of the side wall 35, at the ends of the chamber 19, with the forward land 91 bridging the barrel seal 7, as shown in FIG. 1. The side wall 35 tapers down at 40 to the diameter of the end 30 to fit the tapered portion 13 of the chamber 19.

The cartridge 25 is loaded into the rear end of the barrel 1, while the rear part 5 of the barrel is removed, until the tapered portion 40 engages the tapered portion 13. Then, the rear part 5 is replaced and locked in place to close the breech of the gun. When the cartridge is fired by actuating the firing pin 23, the initiator 79 initiates the igniter 41 which, in turn, ignites the propellant material 49 to start the propulsion of the projectile 29 from the case 27 and barrel 1. When the reaction reaches the rear end of the case 27, the vent flaps 87 are forced outwardly by the gas pressure, thus opening the apertures 85 and permitting some of the gases to enter the flutes 81. At about the same time, the auxiliary propellant material 75 builds up gas pressure behind the end wall 37 of the case 27. The case side wall 35 is collapsed by the gas pressure in the flutes 81, permitting the auxiliary propellant gases to expel the case 27 out of the chamber 17-19 and through the barrel part 3.

In testing the invention, various 152 mm. combinations were tried. Some cases were made from 1031 steel with a wall thickness of 0.016 inch, and others were made from 6061-0 aluminum with a wall thickness of 0.055 inch. Cartridges were fired at temperatures ranging from −40°F. to +125°F. Nearly all of the cases were successfully expelled from the gun barrel without a minimum of residue left in the chamber. The expelled cases consistantly fell within a 3% conical volume approximately 100 yards from the barrel muzzle. The invention is being developed for several types of 152 mm. cartridges used in Gun/Launchers for the Sheridan and M60 Tanks.

What is claimed is:

1. A muzzle-expellable cartridge, adapted to be fired in the chamber of a gun barrel, comprising:

a cartridge case including a side wall of sheet material adapted to fit within said chamber, said case being open at its forward end and having a transverse wall at its rear end;

a projectile releasably attached to said open end;

a main propellant charge disposed within said case in front of said transverse wall for propelling said projectile from said case and through said barrel;

an auxiliary propellant charge located behind said transverse wall for propelling said case forwardly through said barrel after the propulsion of said projectile therefrom;

means for initiating said propellant charges; and means for providing spaces between said side wall of said case and said chamber and for venting a portion of the gases generated by said main projectile charge to said spaces, to collapse said side wall and thereby facilitate removal of said case from said chamber, the last-named means comprising a series of external longitudinal flutes and intermediate ribs formed in and extending along the major portion of the length of said side wall, and apertures in said flutes for venting said gases through said side wall.

2. A cartridge as in claim 1, wherein said side wall comprises a generally-cylindrical rear portion of one maximum diameter and a short forward portion of small diameter to which said projectile is attached, and said flutes extend along almost the entire length of said rear portion.

3. A cartridge as in claim 2, wherein said rear portion of said side wall includes at least one relatively-short non-fluted annular part.

4. A cartridge as in claim 3, wherein said rear portion includes two of said annular parts, one at each end thereof.

5. A cartridge as in claim 1, wherein said apertures are located near the rear end of said side wall.

6. A cartridge as in claim 1, wherein each of said apertures comprises a portion of the wall material in each flute partially severed to form a punch-out flap adapted to be moved outward by gas pressure on firing to permit said gas to enter said flutes.

7. A cartridge as in claim 6, wherein the free ends of said punch-out flaps extend forwardly.

* * * * *